United States Patent [19]

Izzi, Sr.

[11] 4,399,743

[45] Aug. 23, 1983

[54] VENT PIPE CAP

[75] Inventor: Lewis B. Izzi, Sr., Shelby, N.C.

[73] Assignee: Plastic Oddities, Inc., Shelby, N.C.

[21] Appl. No.: 311,615

[22] Filed: Oct. 15, 1981

[51] Int. Cl.[3] ..... F23L 17/02

[52] U.S. Cl. ..... 98/122; 220/287; 220/366; 220/372

[58] Field of Search ..... 98/61, 122, 116; 220/85 P, 287, 366, 372

[56] References Cited

U.S. PATENT DOCUMENTS

| | | | |
|---|---|---|---|
| 510,884 | 12/1893 | Bradley, Jr. | 98/122 |
| 2,488,249 | 11/1949 | White | 98/122 X |
| 2,703,670 | 3/1955 | Voight | 220/287 X |
| 3,031,783 | 5/1962 | Burke | 98/122 X |
| 3,433,145 | 3/1969 | Daly et al. | 98/116 X |
| 4,007,759 | 2/1977 | Martin et al. | 220/372 X |
| 4,023,699 | 5/1977 | Lien | 220/287 X |

FOREIGN PATENT DOCUMENTS

| | | | |
|---|---|---|---|
| 89339 | 7/1957 | Denmark | 98/122 |
| 13597 | 11/1955 | Fed. Rep. of Germany | 220/44 R |

*Primary Examiner*—Albert J. Makay
*Assistant Examiner*—Harold Joyce
*Attorney, Agent, or Firm*—Laurence R. Brown

[57] ABSTRACT

A cap for vent stack pipes of a plurality of sizes which is provided with practical connector means to prevent vandelism or removal of the cap.

1 Claim, 8 Drawing Figures

FIG.5
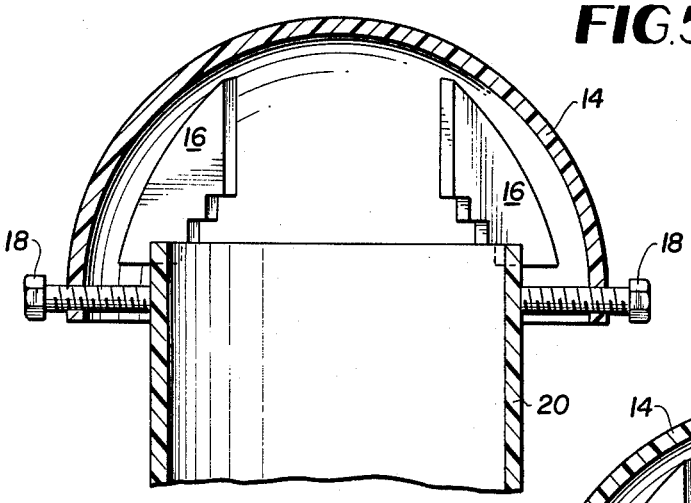
FIG.6
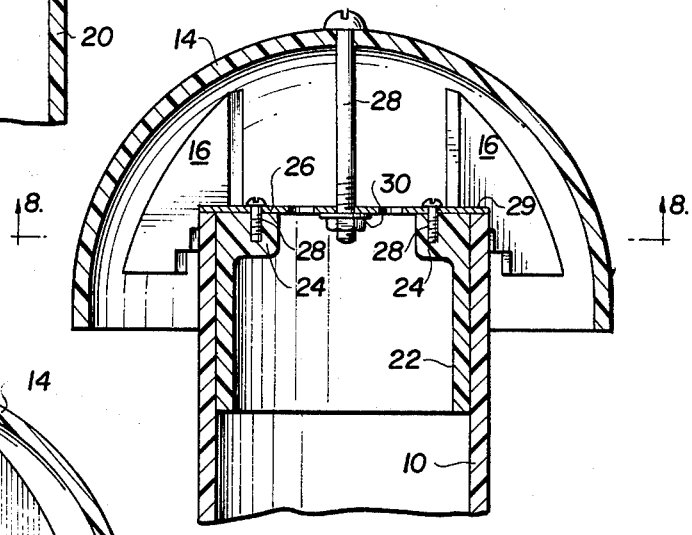
FIG.7
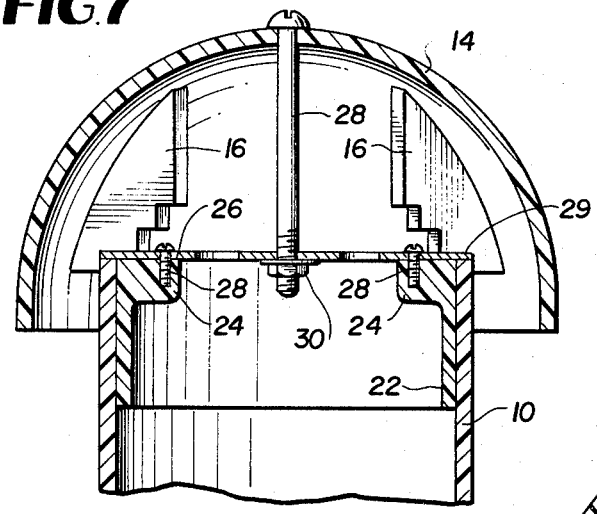
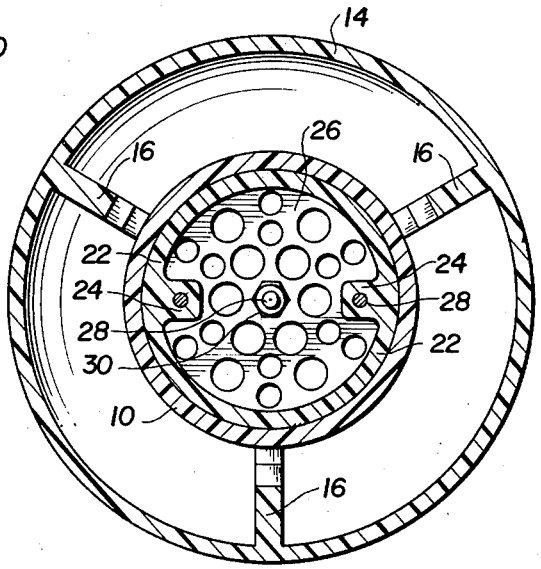
FIG.8

VENT PIPE CAP

This invention relates generally to caps for the vent stacks of buildings and more specifically, to a cap which will fit more than one size of pipe.

As is well known, every building in which plumbing is installed must have at least one main vent stack. In the larger buildings and high rises when a large number of fixtures are installed and where long runs of pipe are necessary, a number of vent pipes protrude from the tops of the buildings. Where the roof is to be used as a sundeck, roof garden or laundry drying area, the top of the vent terminal should be extended 6½ feet so that it is above the height of a person.

When the roof is not intended to serve other than structural purposes, there is no need to extend a vent terminal higher than 6 inches. Under these circumstances, protection is needed against the dropping of sticks, stones, bottles and other debris into the stack so as to still maintain the venting area to let the gases escape from the drainage system.

Accordingly, the main object of the present invention is to provide an improved vent cap for the stacks of buildings.

Another important object of the present invention is to provide an improved vent cap for building stacks which will be secure from casual theft.

An important object of the present invention is to provide a cap for vent terminals of various materials which may be connected thereto quickly and easily at a minimum of cost.

Other objects and advantages of the present invention will become apparent during the course of the following description.

In the drawings I have shown two embodiments of the invention. In these showings:

FIG. 5 is a view similar to FIG. 2 but showing the vent cap being used with a 4 inch stack;

FIG. 6 is a central vertical sectional view of a modified form of the vent cap showing it in use with a 3 inch stack;

FIG. 7 is a similar view showing the cap in use with a 4 inch stack; and

FIG. 8 is a horizontal sectional view thereof taken on the line 8—8 of FIG. 6.

Figure 1:
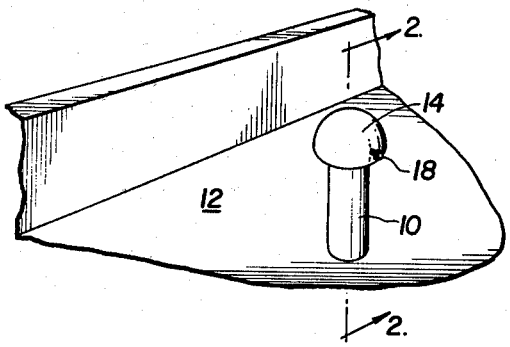
FIG. 1 is a fragmentary perspective view of the roof of a building showing a vent stack and its cap.

Referring to the drawings, numeral 10 designates the vent stack pipe projecting above the roof 12 of a building and having a plastic vent cap 14 secured thereto.

The cap 14 which is an enlarged cover for a stack, is substantially hemispherical in shape and is provided on its inner surface with 3 stair step lugs 16 molded or secured thereto 120° apart. This arrangement allows one vent cap 14 to fit 3 inch and/or 4 inch plastic or other material stack pipe 10 and because the lug steps are ribbed, there is no restriction on the ventilation of gases from the stack as there is always an annular space between it and the cover.

Figure 2:
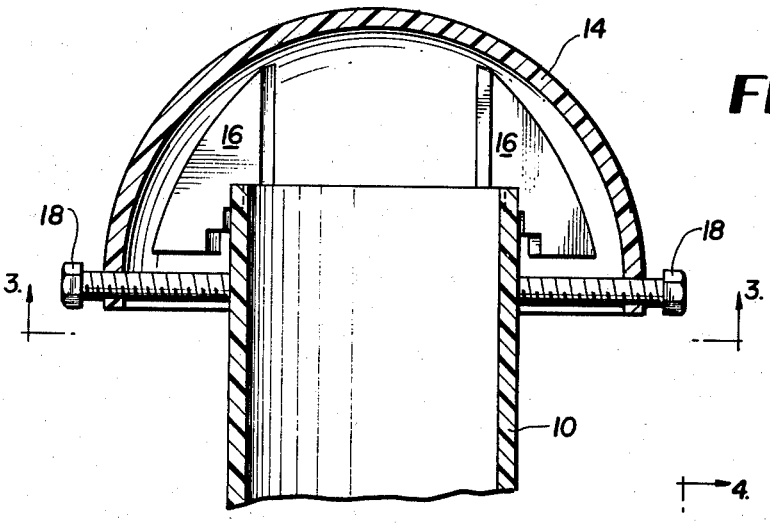
FIG. 2 is a central vertical sectional view thereof on a 3 inch stack.
Figure 3:
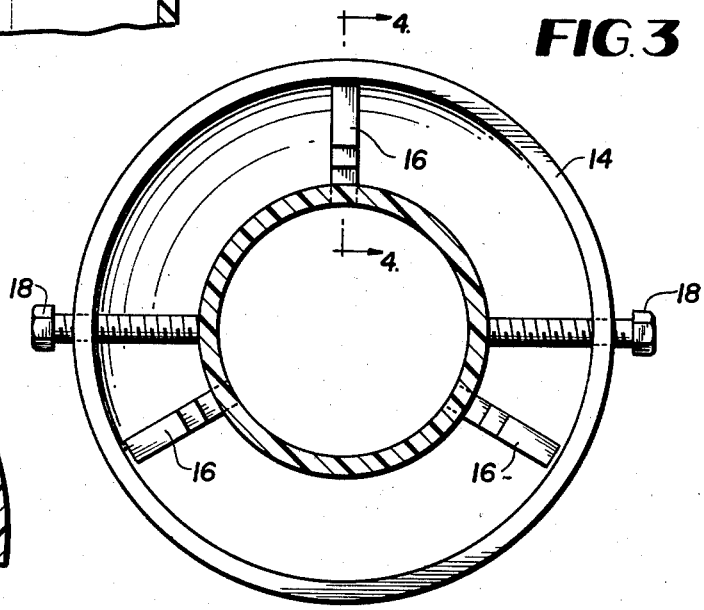
FIG. 3 is a horizontal sectional view thereof taken on the line 3—3 of FIG. 2.
Figure 4:
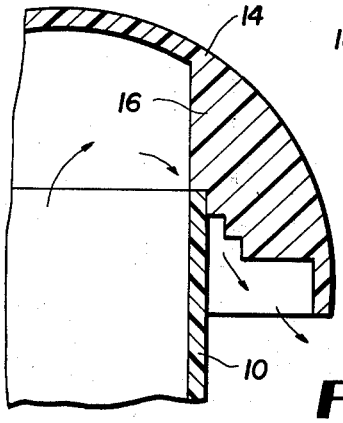
FIG. 4 is a fragmentary vertical sectional view taken on the line 4—4 of FIG. 3 and showing one of the stepped lugs.

While only a pair of security screws 18 are shown in the drawings, three can be employed with each aligned with a stair step lug 16. Thus, a do-it-yourself home owner can make the connection quickly and easily at a minimum of cost and present vandalism or removal of the cap. It is to be noted that FIG. 5 differs from FIGS. 1–4 inclusive only in that a 4 inch pipe 20 seated against the lowest step of the lug 16 is employed.

FIGS. 6–8 show plastic drain fittings 22 having diametrically opposed lugs 24 to which a strainer plate 26 is secured by screws 28. The plate 26 is of greater diameter than the fitting so as to act as a stop 29 for a vent pipe 10 which is solvent welded to the fitting 22. The strainer plate 26 is supported from the cap 14 by a screw 28 and nut 30.

The drain fitting 22 and its strainer plate 26 thus provide an optional means for the escape of gases and also prevents the dropping of debris down the terminal stack 10 to cause problems.

It is to be understood that the forms of my invention herewith shown and described is to be taken as preferred examples of the same and that various changes in the shape, size and arrangement of parts may be resorted to without departure from the spirit of the invention or the scope of the subjoined claims.

What is claimed is:

1. A plumbing cap for a vent stack comprising in combination, a hemispherical plastic cover for overlapping the upper sides and end of a stack; a plurality of circumferentially spaced support lugs fixed to the inside of the cover and disposed completely inside its hemisphere; said lugs having a plurality of stair steps formed on their inner faces to fit closely on the ends of stacks of various pipe sizes and spacing the stack inside said cover and positioned to hold the cover overlapped over the upper sides and end of the stack enough to prevent lateral entry of foreign materials into the stack while maintaining the stack freely vented for exit of gases without impediment; said stack comprises a plastic pipe; and securing means comprising a plastic drain fitting dimensioned to be solvent welded inside said stack, a strainer plate fixed to said fitting and resting on said stack, and bolt means connecting said cover to said plate for securing said cover to the stack in a position with one stair step adjacent the end of the stack thereby permitting gases to freely escape from the stack about the cap while protecting the stack from entry of materials.

* * * * *